United States Patent [19]

Ishikawa et al.

[11] 4,400,782

[45] Aug. 23, 1983

[54] CORROSION MONITORING SYSTEM USING A METAL PIPE FOR TRANSMISSION OF MONITORING SIGNALS

[75] Inventors: Masashi Ishikawa; Masatoshi Shimada; Katsutomo Okamoto, all of Tokyo; Shigeyoshi Sugita, Shiroimachi; Masayuki Goto; Yukuo Koizumi, both of Yokohama; Osamu Kaneda, Yono, all of Japan

[73] Assignee: Nippon Electric Co., Ltd., Tokyo, Japan

[21] Appl. No.: 238,107

[22] Filed: Feb. 25, 1981

[30] Foreign Application Priority Data

Feb. 29, 1980 [JP] Japan ..... 55-25451

[51] Int. Cl.[3] ..... G01V 3/00; G01R 31/02

[52] U.S. Cl. ..... 364/481; 324/72; 324/323; 364/420; 364/550

[58] Field of Search ... 364/481, 420, 550, 200 MS File, 364/900 MS File; 324/72, 323; 204/195 C

[56] References Cited

U.S. PATENT DOCUMENTS

| | | | |
|---|---|---|---|
| 4,003,815 | 1/1977 | Ikeda et al. | 324/72 |
| 4,078,510 | 3/1978 | Morgan | 324/72 |
| 4,322,805 | 3/1982 | Rog et al. | 364/420 |

*Primary Examiner*—Errol A. Krass

*Attorney, Agent, or Firm*—Laff, Whitesel, Conte & Saret

[57] ABSTRACT

In a monitoring system for protecting a metal pipe against corrosion, transmission of monitoring signals is carried out by the use of the pipe itself as a transmission line between a center station and a substation, which are coupled to the pipe at center and subordinate locations, respectively. The substation sends data signals over the pipe to the center station. These data signals represent the degree of corrosion that is measured at the subordinate location and are monitored by the center station. When a plurality of substations are coupled to the pipe, the center station selects a substation by transmitting through the pipe an address assigned to the substation. Each substation returns the assigned address to the center station in combination with the signals representing the measured degree of corrosion at the addressed substation. Preferably, the center station produces the selected address twice while each substation produces the assigned address and the measured corrosion signal, twice. Alternatively, the center station supplies a control signal in combination with the selected address, from the center station to remotely control each substation. A repeater may be interposed between the center station and the substation.

8 Claims, 11 Drawing Figures

CORROSION MONITORING SYSTEM USING A METAL PIPE FOR TRANSMISSION OF MONITORING SIGNALS

BACKGROUND OF THE INVENTION

This invention relates to a monitoring system for monitoring a degree of corrosion of a metal pipe, such as a gas pipe, or the like.

A metal pipe of the type described is more or less subjected to corrosion, such as electrolytic corrosion, when surrounded by a mass. For example, when it is buried in soil or immersed in water the soil and water form the mass. The cathodic protection is usually used in the art to protect the pipe from being corroded, as by an electrolyte which may be in the mass, as will later be described with reference to a few figures of the accompanying drawing. At any rate, a degree of corrosion of the pipe should be periodically monitored in some way or other to carry out maintenance of the pipe. Otherwise, unexpected breaks often take place somewhere on the pipe. In order to save time and labor, it is preferable for the degree of corrosion be automatically monitored at a remote station.

A monitoring system disclosed in Japanese Patent Publication No. Syo 53-6552, namely, 6552/78, comprises a pipe surrounded by a mass, a pair of cables along the pipe, a plurality of relays connected across the cable pair and spaced from one another, an indicator, and a plurality of measuring electrodes connected to the indicator through the contacts of the respective relays. When one of the relays is selectively put into operation through the cable pair, the corresponding measuring electrode is electrically connected to the indicator through the contact of the operated relay. As a result, the indicator is supplied with an electric potential between the pipe and the measuring electrode. A degree of corrosion is detected from the electric potential given to the indicator. Thus, it is possible to remotely monitor the degree of corrosion of the pipe.

With this system, the cables should be extended along the pipe in the air or soil. Therefore, extra spaces have to be prepared to lay the cables along the pipe. In addition, the cables may be broken, as during road repairing when they are buried in soil along a street. Restoration of the cable is very difficult once they are broken.

SUMMARY OF THE INVENTION

It is, therefore, an objeot of this invention to provide a monitoring system which is capable of automatically and remotely monitoring a degree of corrosion of a metal pipe surrounded by a mass.

It is another object of this invention to provide a monitoring system of the type described, for which no extra spaces are necessary.

It is still another object of this invention to provide a monitoring system of the type described, which is hardly affected by road repairing even buried underground along a street.

A monitoring system to which this invention is applicable is for monitoring a degree of corrosion of a metal pipe surrounded by a mass. The degree of corrosion becomes worse as time goes by when the pipe is surrounded by an electrolyte in the mass, and the degree changes from location to location along the length of the pipe. The pipe has a distribution of electrical quantity therealong. The distribution is variable with the degree of corrosion which has occurred.

According to this invention, the monitoring system comprises a center station connected to the pipe at a predetermined location and a substation connected to the pipe at a different and preselected location, for detecting the increased degree of corrosion at the preselected location. The substation supplies the pipe with a substation signal representative of the detected increased degree of corrosion. The center station responds to the substation signal supplied through the pipe to monitor the detected degree.

DESCRIPTION OF THE PREFERRED EMBODIMENTS

Figure 1:
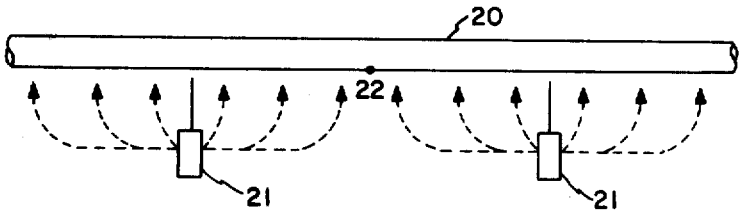
FIG. 1 shows a diagram for describing the cathodic protection for protecting a metal pipe against corrosion.
Figure 2:
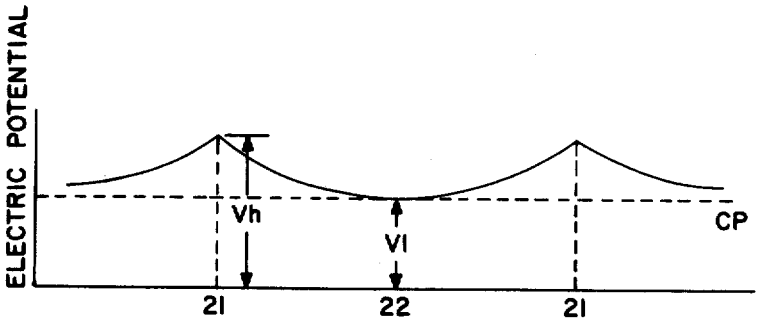
FIG. 2 shows a diagram for describing a distribution of electric potential along the metal pipe illustrated in FIG. 1.

Referring to FIGS. 1 and 2, the cathodic or electrolytic protection will be described for a better understanding of this invention. The cathodic protection is used to protect a pipe 20 of metal, such as iron, against corrosion. In FIG. 1, the pipe 20 is surrounded by a mass, such as soil or water. A plurality of metal electrodes 21 are arranged adjacent to the pipe 20, from location to location, with spaces left therebetween and are electrically connected to the pipe 20 by wires depicted by short solid lines. Each of the electrodes 21 is composed of a material, such as zinc or magnesium, which has a stronger ionization tendency than the pipe metal 20, namely, which is electrochemically less noble than the pipe metal. Each electrode 21 serves as an anode for discharging electrons which would otherwise accumulate on the pipe surface to corrode the pipe 20. More particularly, a corrosion-proof current (not shown) flows through a current path of the anode 21, the mass (e.g. an electrolyte naturally occuring in adjacent soil or water), the pipe 20, and back to the anode 21. The anodes 21 sacrificially protect the pipe 20. The corrosion-proof current may be forcibly caused to flow through the pipe 20 from an external electric source (not shown).

Referring to FIG. 2, the pipe 20 has a distribution of electric potential along its length. A maximum potential $v_h$ of, for example, minus 2.5 V appears at a location of each anode 21 and a minimum potential $v_e$ of, for example, minus 0.85 V, at an intermediate location 22 between adjacent anodes 21. The minimum potential $v_e$ provides a corrosion-proof potential CP. The electric potential along the pipe 20 should be between minus 0.85 and minus 2.5 V in order to protect the pipe 20 against the corrosion. Spacings between the anodes 20 are selected to provide such a distribution of electric potential. The distribution is variable with a degree of corrosion. Therefore, an electric potential or corrosion-proof potential CP is measured and monitored to protect a pipe 20 against of corrosion an unsatisfactory degree.

In addition, such a distribution of electric potential may spontaneously vary, owing to any electrical induction when a pipe 20 is adjacent to a conductor for the power supply. In this case, the spontaneous potential may be monitored.

Figure 3:
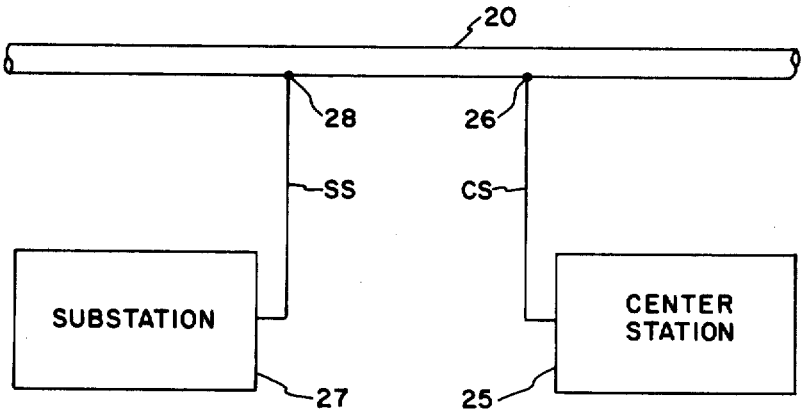
FIG. 3 is a block diagram of a monitoring system according to each of first and second embodiments of this invention.

Referring to FIG. 3, a monitoring system according to a first embodiment of this invention is shown for monitoring a degree of corrosion of a metal pipe 20. As in FIGS. 1 and 2, the metal pipe 20 is surrounded either by soil or water and has a distribution of an electrical quantity, such as the electric potential, therealong. Inasmuch as the distribution of potential varies with the degree of corrosion which may already have occurred, the monitoring system monitors the degree by remotely detecting the distribution of electric potential.

More particularly, the monitoring system comprises a center station 25 connected to the pipe 20 at a predetermined or center location 26 and a substation 27 connected to the pipe 20 at a preselected or subordinate location 28. The substation 27 detects the electric potential at the subordinate location 28 at the end of each successive prescribed period of time, for example, 12 hours or 24 hours to supply the pipe 20 with a substation signal SS representative of the detected degree, namely, the electric potential. According to our experimental study, it has been confirmed that a pipe of iron has an electrical resistance of about 17 milliohms or so per kilometer, when the pipe has a diameter of 35 centimeters and a wall thickness of 1 centimeter. This means that the metal pipe 20 has a distributed resistance which makes it sufficiently usable as a signal transmission line. Taking the above into consideration, the substation signal SS is transmitted through the pipe 20 to the center station 25. The center station 25 monitors the degree of corrosion in response to the substation signal SS and gives an alarm, if the degree is objectionable. Thus, the system according to the first embodiment forms a one-way communication system from the substation 27 to the center station 25 and is effective when a single substation 27 is placed along the pipe 20.

Figure 4:
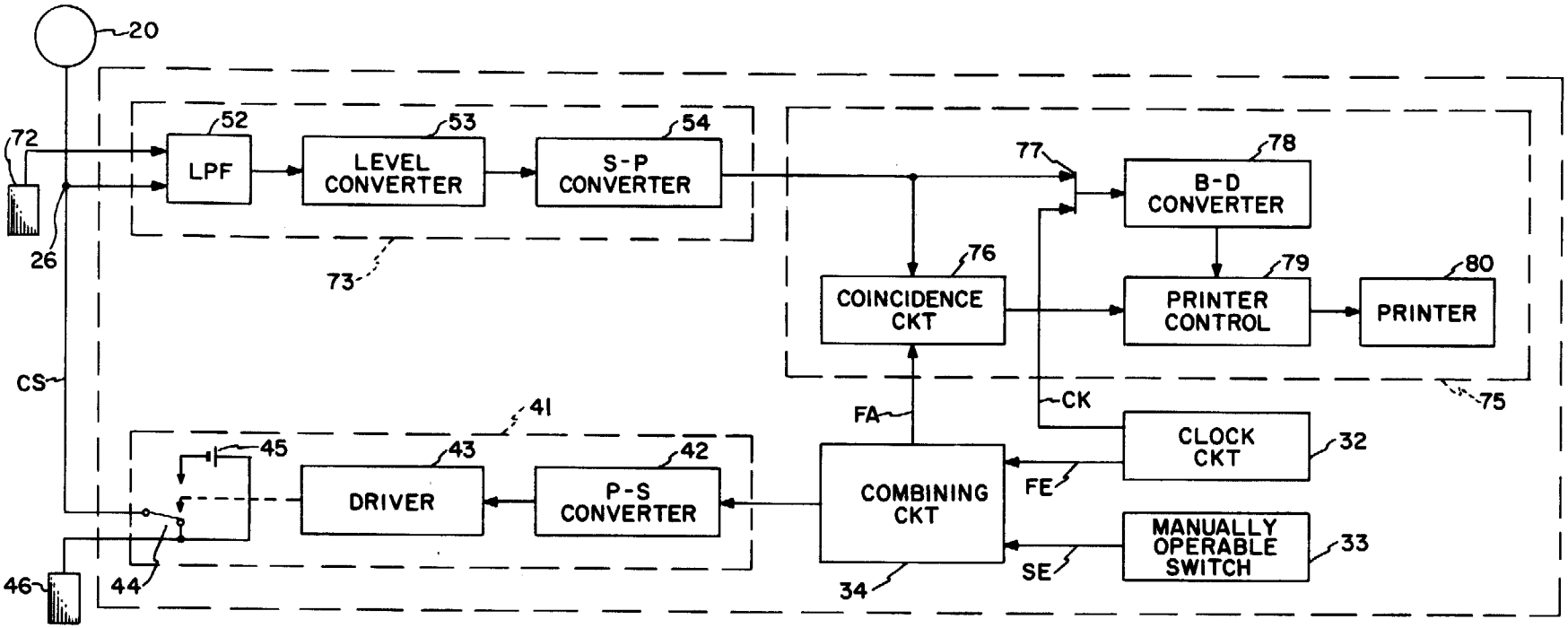
FIG. 4 is a block diagram of a center station used in the monitoring system according to the second embodiment.
Figure 5:
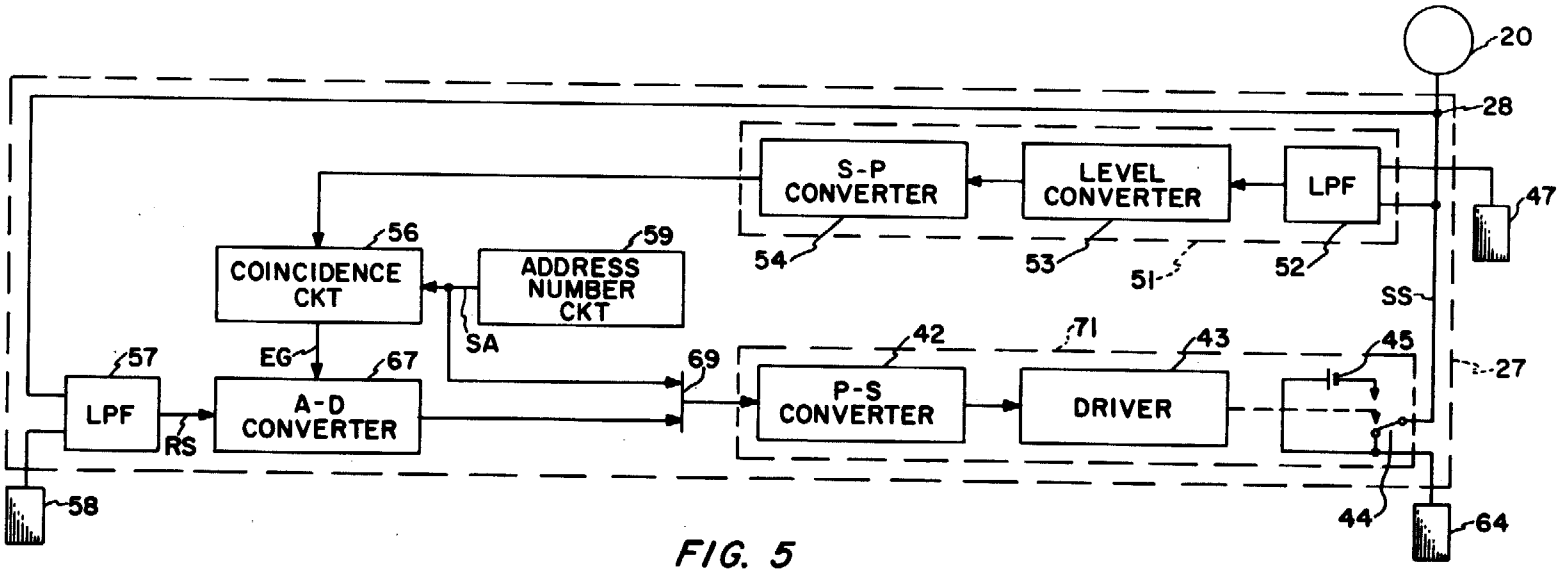
FIG. 5 is a block diagram of a substation used in the monitoring system according to the second embodiment.

Referring to FIGS. 3, 4, and 5, a monitoring system according to a second embodiment of this invention comprises a center station 25 and a plurality of substations 27 which are similar to one another, although only one substation is illustrated in FIG. 3. The center station 25 and the substations 27 are connected to a metal pipe 20 at a center location 26 and subordinate locations 28, respectively.

Each of the substations 27 is assigned with an address number peculiar thereto and is selectively operated by the center station 25 to transmit a substation signal SS to the center station 25. In other words, the monitoring system according to the second embodiment provides a two-way communication system between the center station 25 and the substations 27.

In the example being illustrated, the center station 25 and each substation 27 form an automatic repetition system for transmitting every signal twice. It is assumed that each of the substations 27 can selectively measure an electric potential at the subordinate location 28 of each substation 27 and an electric current flowing through the subordinate location 28. In other words, each substation 27 is operable for measuring the degree of corrosion in different modes.

Referring more specifically to FIG. 4, the center station 25 comprises a clock circuit 32 for automatically generating a first enable signal FE, once every day, at a predetermined time. A clock signal CK every minute and a manually operable switch circuit 33 produces a second enable signal SE when it is manually operated. Both of the first and the second enable signals FE and SE are supplied to a signal combining circuit 34.

Figure 6:
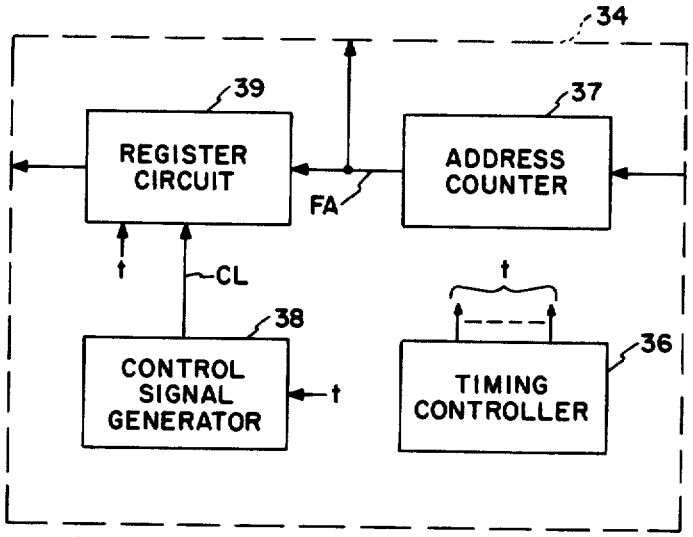
FIG. 6 is a block diagram of a signal combining circuit of the center station illustrated in FIG. 4.

Turning to FIG. 6 for a short while, the signal combining circuit 34 comprises a timing controller 36 for putting the remaining parts of the circuit 34 into operation by delivering various timing signals or pulses t in accordance with a predetermined sequence. The timing signals t will not be described in detail because they are merely for use in timing the remaining parts. Responsive to either the first enable signal FE or the second enable signal SE, an address counter 37 begins to successively count a particular one of the timing pulses t and to select, one at a time, the address numbers assigned to the substations 27. A succession of the particular timing pulses may be supplied from the clock circuit 32 and appears at a predetermined period of, for example, two seconds. The address counter 37 keeps the selected address number during the predetermined period. The selected address number is represented by a first parallel address signal FA in a bit parallel fashion. Let the address signal FA have eight bits. It is possible with the address counter 37 to select up to 255. Thus, the address counter 37 serves as an address selecting circuit in combination with the clock circuit 32 and/or the manually operable switch circuit 33.

In FIG. 6, a control signal generator 38 generates a control signal CL specifying each of the measurement modes and supplies a register circuit 39 with the control signal CL in a bit parallel fashion of eight bits. Responsive to the first parallel address signal FA and the control signal CL and controlled by the timing pulses t, the register circuit 39 first produces the first parallel address signal FA twice and, thereafter, the control signal CL twice. Thus, each of the first parallel address signals FA and the control signals CL successively appears as a bit parallel signal.

Figure 7:
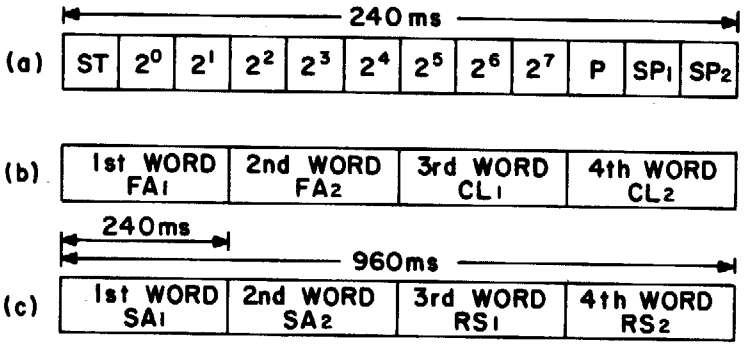
FIG. 7 shows a diagram for describing a station signal and a substation signal produced by the station and the substation which are illustrated in FIGS. 4 and 5, respectively.

Referring to FIG. 4 again and FIG. 7 afresh, the center station 25 comprises a transmitter portion 41 responsive to each of the parallel bit signals and connected to the pipe 20 at the center location 26. The transmitter portion 41 comprises a parallel-serial converter 42 for converting the respective parallel bit signals to the corresponding serial bit signals of eight bits. As detailed in FIG. 7(*a*), a start bit ST, a parity check bit P, and a pair of stop bits $SP_1$ and $SP_2$ are added by the parallel-serial converter 42 to each serial signal of eight bits, namely, $2^0$ through $2^7$, to form one word of 12 serial bits. This is for resorting to the start-stop method.

As readily understood from the above, the first parallel address signal FA is supplied from the parallel-serial converter 42 in a first word and a second word following the first word while the control signal CL successively appears in a third and a fourth word following the second word, as shown in FIG. 7(*b*). In other words, the first parallel address signal FA is converted to first preceding and first succeeding serial address signals $FA_1$ and $FA_2$ while the control signal CL, preceding and succeeding control signals $CL_1$ and $CL_2$. At any rate, the parallel-serial converter 42 serves to produce an address signal at least once. That address is representative of the selected address number in combination with the register circuit 39 illustrated in FIG. 6.

In FIG. 4, the transmitter portion 41 comprises a driver 43 and a transmitting switch 44. The transmitting switch 44 is connected to a d.c. voltage source 45 for providing an electric voltage of, for example, about 5 volts. The positive terminal of the voltage source 45 is connected to a first electrode 46, which is grounded. The switch 44 is placed between the pipe 20 and the first electrode 46 and is driven by each of the serial signals supplied from the parallel-serial converter 42 through the driver 43. The switch 44 is changed over to be connected to the negative terminal of the voltage source 45 only when supplied with a logic "1" level. As a result, the source voltage is instantaneously impressed between the first electrode 46 and the pipe 20. The impression of pulse the source voltage momentarily causes a pulse electric current to flow through the transmitter portion 41, the first electrode 46, any electrolyte in the mass, and the pipe 20. Inasmuch as the pipe 20 is kept at certain electric potentials at different locations along its length, as described with reference to FIG. 2, the source voltage is superposed on the electric potential distribution along the pipe 20. When the serial signal bit takes a logic "0" level, the switch 44 is kept in the position shown in FIG. 4, no source voltage is impressed between the first electrode 46 and the pipe 20.

From this fact, it is readily understood that the pipe 20 is successively supplied as a station signal CS with the first through fourth words illustrated in FIG. 7(*b*). Thus, the driver 43, the transmitting switch 44, and the voltage source 45 supply the pipe 20 with the station signal CS.

Referring more particularly to FIG. 5, the substation 27 is supplied with the station signal CS consisting of the first through fourth words. Each bit of the words is impressed between the subordinate location 28 of the pipe 20 and a second electrode 47 grounded and appears as a variation of electric potential therebetween. Inasmuch as certain electric potential, namely, a corrosion-proof potential and/or spontaneous potential is present between the location 28 and the second electrode 47 together with any ripples based on a noise current, the station signal CS is superposed on such electric potential and ripples.

A receiver portion 51 removes such spontaneous or corrosion proof potential and any ripples to accurately derive the first through fourth words supplied through the pipe 20. More particularly, the receiver portion 51 comprises a first low-pass filter 52, a level converter 53, and a serial-parallel converter 54. The ripples are suppressed by the first low-pass filter 52 while the spontaneous or corrosion-proof potential is remmoved by the level converter 53. As a result, each of the first through fourth words is successively delivered to the serial-parallel converter 54 and is converted by the converter 54 to each of parallel bit signals. Simultaneously, a parity check is carried out in the serial-parallel converter 54 in a usual manner. Thus, the preceding and the succeeding first address signals $FA_1$ and $FA_2$ illustrated in FIG. 7(*a*) are individually produced as a first and a second word in a parallel bit fashion. Likewise, the preceding and the succeeding control signals $CL_1$ and $CL_2$ are produced as a third and a fourth word in a parallel bit manner after production of the first address signals $FA_1$ and $FA_2$. These parallel bit words are supplied to a coincidence circuit 56, as will be described soon.

In FIG. 5, the substation 27 comprises a second low-pass filter 57 connected to the pipe 20 at the subordinate location 28 and a third grounded electrode 58. The second low-pass filter 57 removes the ripples to derive the corrosion-proof potential or the spontaneous potential. In other words, the second low-pass filter 57 is for measuring the degree of increase in corrosion which may have occurred at the subordinate location 28 to produce a result signal RS representative of the measured potential or degree of corrosion. The result signal RS is given in an analog form.

The substation 27 further comprises an address number circuit 59 holding a second address signal SA representative of the address number assigned to the substation 27 by eight bits. The address number circuit 59 may be a read-only memory and generates the second address signal SA twice in a parallel bit fashion. Therefore, the second address signal SA appears on the pipe 20 in the form of second preceding and second succeeding address signals $SA_1$ and $SA_2$, as illustrated in FIG. 7(*c*).

Figure 8:
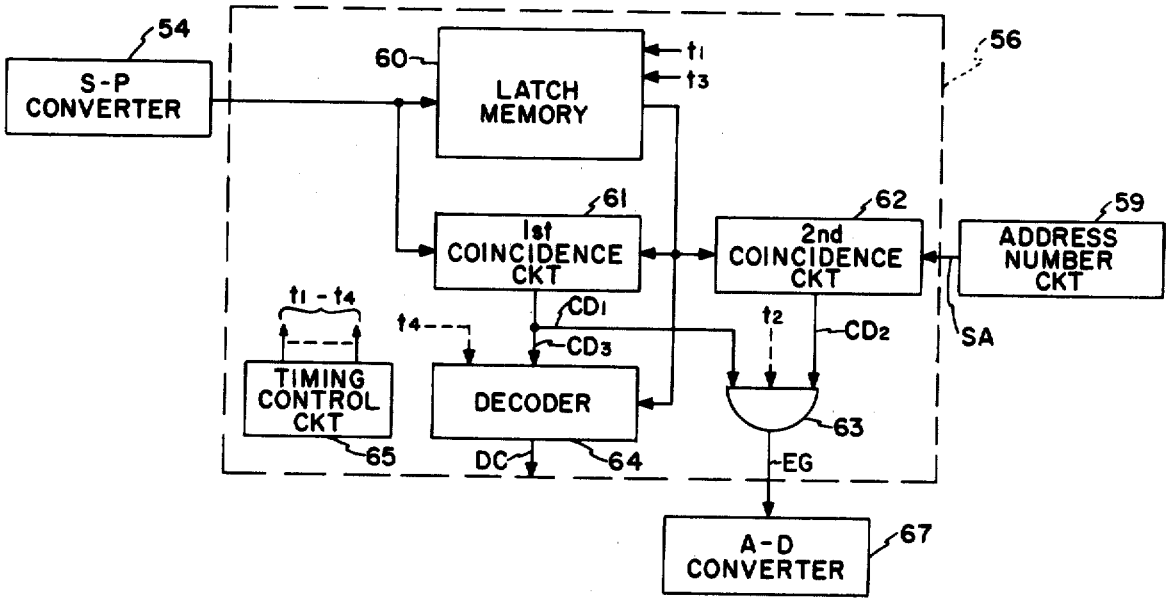
FIG. 8 shows a block diagram of a coincidence circuit of the substation illustrated in FIG. 5.

Referring to FIG. 5 again and FIG. 8 afresh, the substation 27 comprises the coincidence circuit 56 which is suitable for the automatic repetition system. The coincidence circuit 56 comprises a latch circuit 60, a first coincidence gate circuit 61, a second coincidence gate circuit 62, an AND gate 63, and a decoder 64. In addition, the coincidence circuit 56 is provided with a timing control circuit 65 for producing first through fourth timing pulses $t_1$, $t_2$, $t_3$, and $t_4$ in a timed relationship to the first through fourth words. The first through fourth words are supplied, one at a time, from the receiver portion 51 and include the first address signals $FA_1$ and $FA_2$ and the control signals $CL_1$ and $CL_2$ all of which are illustrated in FIG. 7(*b*).

At first, the first word supplied from the serial-parallel converter 54 is kept in the latch memory 60 in synchronism with the first timing pulse $t_1$. Subsequently, the second word is sent to the first coincidence gate circuit 61 to be compared with the first word kept in the latch memory 60. The first coincidence gate circuit 61 produces a first coincidence signal $CD_1$ upon coincidence of both of the first word and the second word. Simultaneously, the second coincidence gate circuit 62 compares the first word kept in the latch memory 60 with the second address signal held in the address number circuit 59 to produce a second coincidence signal $CD_2$ upon coincidence of both of the first word and the address number assigned to the substation 27. The first and the second coincidence signals $CD_1$ and $CD_2$ are supplied to the AND gate 63 in a timed relationship to the second timing pulse $t_2$. As a result, the AND gate 63 produces a first energizing signal EG in the presence of both of the first and the second coincidence signals $CD_1$ and $CD_2$. The first energizing signal is supplied to an analog-to-digital (A-D) converter 67, which is depicted also in FIG. 5 and will later be described.

After the third word is memorized in the latch memory 60 in timed relation to the third timing pulse $t_3$, the first coincidence gate circuit 61 compares the fourth word with the third word memorized in the latch memory 60. Upon coincidence of both of the third and the fourth words, the first coincidence gate circuit 61 supplies the decoder 64 with a third coincidence signal $CD_3$ to enable the decoder 64. The decoder 64 decodes the third word into a decoded control signal DC. The decoded control signal DC is delivered, for example, to the A-D converter 67 to select a predetermined one of the measuring modes. The decoded control signal DC may be delivered to any other electric circuit. At any rate, the decoded control signal DC is used to control operation of the substation 27.

Turning back to FIG. 5, the A-D converter 67 converts the analog result signal RS to a digital one. The illustrated A-D converter 67 produces the digital result signal of eight bits twice in a parallel bit fashion. Therefore, the digital result signal appears on the pipe 20 in the form of preceding and succeeding result signals $RS_1$ and $RS_2$, as illustrated in FIG. 7(*c*). The digital result signal RS of eight bits is capable of representing 255 levels. Since the electric potential to be measured falls within a range of 0 and minus 2.55 V, it is possible to made the least significant bit correspond to minus 0.01 V. Connected to the address number circuit 59 and the A-D converter 67, an OR circuit 69 supplies a transmitter portion 71 with the second address signal SA of eight parallel bits twice and, thereafter, with the digital result signal of eight parallel bits twice. The transmitter portion 71 in the substation 27 is similar to the transmitter portion 41 described in conjunction with FIG. 4. Therefore, elements in the transmitter portion 71 are designated by like reference numerals. Each of the second address signals SA is converted to a series address signal of eight bits representative of the assigned address number. Thereafter, each of the digital result signals RS is converted to a series result signal of eight bits. In the parallel-serial converter 42, a parity bit P, a start bit ST, and a pair of stop bits illustrated in FIG. 7(*a*) are added to each of the serial address signals and the serial result signals. The pipe 20 is supplied with a substation signal SS consisting of the first through fourth words, as shown in FIG. 7(*c*). The first and the second words include the second preceding and the second succeeding address signals $SA_1$ and $SA_2$, respectively, while the third and the fourth words, the preceding and the succeeding result signals $RS_1$ and $RS_2$.

In FIG. 4, the substation signal SS illustrated in FIG. 7(*c*) is reproduced through a receiver portion 73 and is supplied in a bit parallel fashion to a processing circuit 75. The receiver portion 73 comprises elements which are similar to those of the receiver portion 51 of the substation 27 and designated by like reference numerals. Description will not be repeated as regards these elements. The processing circuit 75 comprises a coincidence circuit 76, an OR gate 77, a binary-to-decimal converter 78, a printer controller 79, and a printer 80. The coincidence circuit 76 is similar to the coincidence circuit 56 described with reference to FIG. 5. The coincidence circuit 76 produces a fourth coincidence signal upon coincidence of both of the preceding and the succeeding ones $SA_1$ and $SA_2$ of the second address signals. Simultaneously, the second preceding address signal $SA_1$ is compared with the first address signal FA kept in the address counter 34 to produce a fifth coincidence signal. A second energizing signal is supplied to the printer controller 79 in the presence of the fourth and the fifth coincidence signals. Thereafter, the preceding and the succeeding result signals $RS_1$ and $RS_2$ are compared with each other to produce a sixth coincidence signal upon coincidence of both of the result signals $RS_1$ and $RS_2$. The measured degree represented by each of the result signals $RS_1$ and $RS_2$ is supplied through the OR gate 77 to the binary-to-decimal converter 78. The clock signal CK is also given to the binary-to-decimal converter 78 through the OR circuit 77 from the clock circuit 32. Thus, the measured degree and the time represented by the clock signal CK are delivered to the printer controller 78 in a decimal form and are recorded on a recording medium by the printer 80 under the control of the printer controller 79 when the second energizing signal and the sixth coincidence signal are supplied from the coincidence circuit 76 to the printer controller 79. Simultaneously, the address number selected by the center station is recorded on the medium by selecting one of the received address signals $RS_1$ and $RS_2$.

Figure 9:
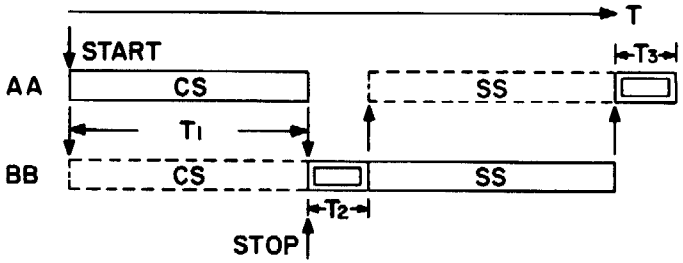
FIG. 9 is a timing chart for describing transmission between the center station and the substation according to the second embodiment.

Referring to FIG. 9, the various states of the center station 25 and a substation 27 selected by the center station 25 are represented in horizontal rows AA and BB, respectively. The station signal CS illustrated in FIG. 7(*a*) is transmitted from the center station 25 during a predetermined period $T_1$ of, for example, 960 milliseconds, as shown in row AA (FIG. 9) and is received by the substation 27, as depicted by a dashed-line box in row BB. After receiving the station signal CS, the substation 27 measures the degree or amount of corrosion which may have occurred to convert the measured degree to a digital signal a duration $T_2$ of, for example, five milliseconds. Thus, the degree of corrosion is measured during an absence of any signals transmitted through the pipe 20. This is for preventing the corrosion-proof potential or the spontaneous potential from being affected by the signals. The digital signal representative of the measured degree or amount of corrosion is transmitted from the substation 27 in the form of a substation signal SS illustrated in BB. The substation signal SS lasts throughout the predetermined period $T_1$, as is the case with the station signal CS, and is received by the center station 25 as shown by another dashed-line box in AA. The substation signal SS received by the center station 25 is processed during a preselected period $T_3$ to be printed on a pertinent medium by the use of the printer 80. Thereafter, the center station 25 starts to select the next following substation. The center station 25 selects the same substation of no substation signal SS is received thereby.

Figure 10:
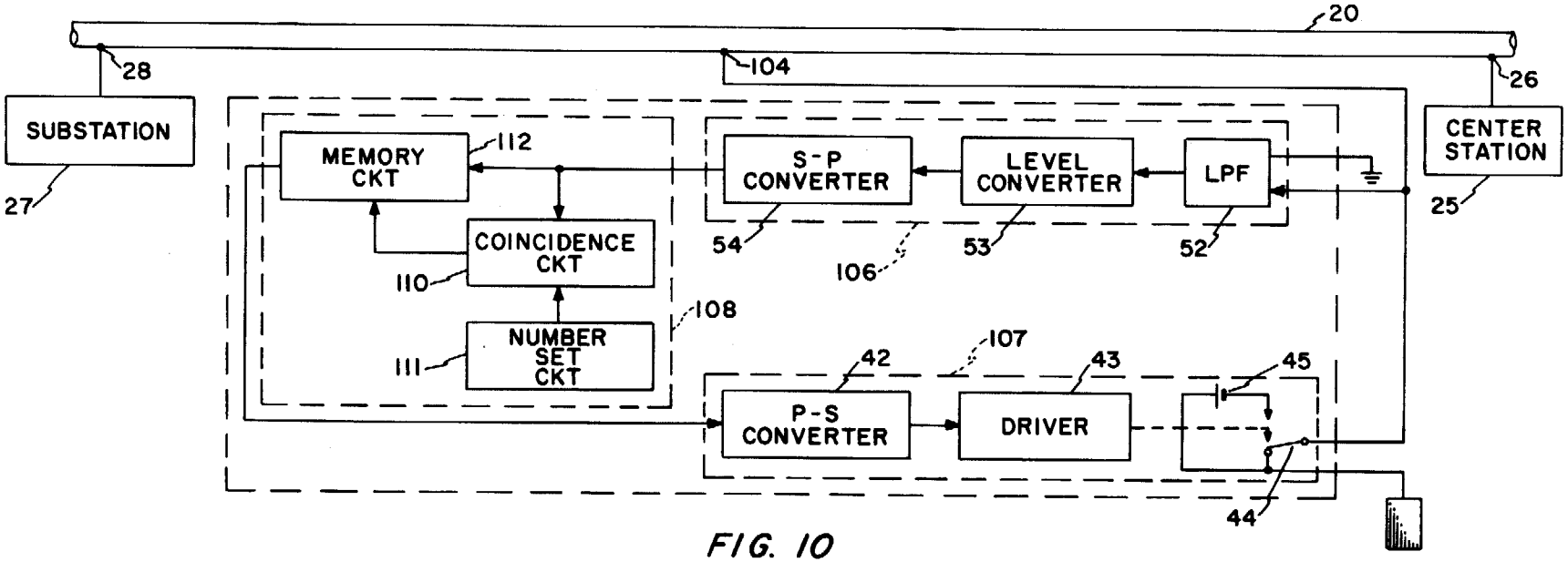
FIG. 10 shows a block diagram of a monitoring system according to a third embodiment of this invention.

Referring to FIG. 10, a monitoring system according to a fourth embodiment of this invention comprises a repeater 105 which is connected to pipe 20 at location 104. The repeater is located between a center station 25 and a specified substation 27, both of which are connected to a pipe 20 at a predetermined or center location 26 and a subordinate location 28, respectively, and which are similar to those illustrated with reference to FIGS. 4 and 5, respectively. Herein, it is assumed that the specified substation 27 is spaced away from the center station so that the station and substation signals are unable to be effectively received at the substation 27 and the center station 25, respectively. In other words, the substation 27 is not located within a useful distance for effectively carrying out transmission between the substation 27 and the center station 25. The useful distance is determined by an electrical resistance of the pipe 20 taken with respect to the potential of the mass surrounding the pipe, signal levels impressed on the pipe 20, and so forth.

The repeater 105 is placed at a repeating location 104 between the center station 25 and the substation 27, with useful distances left between the repeater 105 and the center station 25 and between the repeater 105 and the substation 27. The repeater 105 comprises a receiver portion 106 and a transmitter portion 107 both of which are similar to those illustrated in the receiver portions 73 and 51 and the transmitter portions 41 and 71 of FIGS. 4 and 5. Therefore, elements included in the receiver and the transmitter portions 106 and 107 are designated by like reference numerals and will not repeatedly be described.

Temporarily referring back to FIGS. 7 and 9, the repeater 105 is supplied with either the station signal CS illustrated in FIG. 7(*a*) or the substation signal SS illustrated in FIG. 7(*c*). A concatenation of the first through fourth words is supplied to the repeater 105 and the first and the third words are identical with the second and the fourth words, respectively. In addition, each of the first and the second words is given an address signal representative of the specified substation 27.

Turning back to FIG. 10, the repeater 105 comprises a repeater portion 108 comprising, in turn, a number setting circuit 110, a coincidence circuit 111, and a memory circuit 112. The number setting circuit 110 produces in a serial bit fashion a specified address representative of the specified substation 27 which requires the repeating operation. Responsive to the first and the second words and the specified address, the coincidence circuit 111 supplies the memory circuit 112 with the first word when a coincidence is detected between the first and the second words and between the specified address and a particular one of the first and the second words. As a result, the memory circuit 112 memorizes the address assigned to the specified substation 27. It is to be noted here that the repeater 105 is kept inactive when no coincidence is detected. Therefore, it is possible to protect the repeater 105 from being uselessly operated.

Subsequently, the coincidence circuit 110 compares the third word with the fourth word to supply the memory circuit 112 with the third word upon coincidence of the third and the fourth words. Thus, the first and the third words are memorized in the memory circuit 112.

Each of the memorized first and third words is read out from the memory circuit 112 and is supplied to the transmitter portion 107. The transmitter portion 107 produces a repeater output signal of four words in the manner described with reference to FIG. 4. In the memory circuit 112, the second and the fourth words may be memorized.

Figure 11:
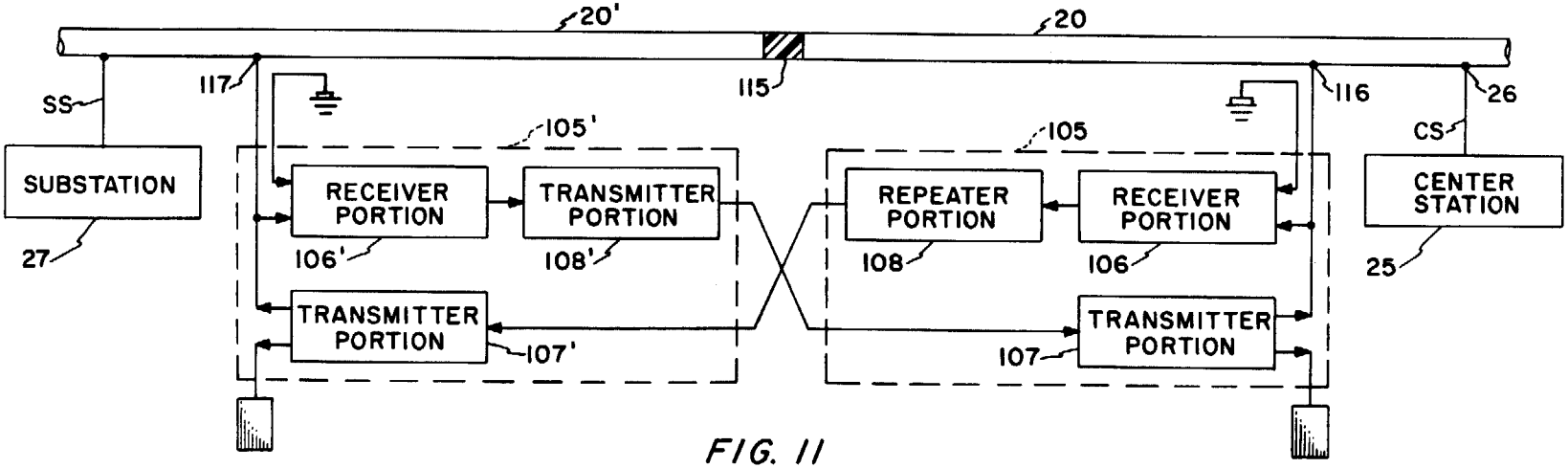
FIG. 11 shows a block diagram of a monitoring system according to a fourth embodiment of this invention.

Referring to FIG. 11, a monitoring system according to a fifth embodiment of this invention is for a pair of metal pipes 20 and 20' connected together with an insulator 115 interposed. A center station 25 is connected to the pipe 20 at a center location 26 and is similar to that illustrated with reference to FIG. 4. A substation 27 is connected to the pipe 20' at a subordinate location 28 and is similar to that illustrated with reference to FIG. 5.

A first repeater 105 is connected to a first repeating location 116 between the center location 26 and the insulator 115 while a second repeater 105', a second repeating location 117 between the subordinate location 28 and the insulator 115. Each of the first and the second repeaters 105 and 105' comprises a receiver portion 106; 106', a transmitter portion 107; 107', and a repeater portion 108; 108', as is the case with the repeater 105 illustrated with reference to FIG. 10. It should be noted here that the repeater portion 108 of the first repeater 105 is connected to the transmitter portion 107' of the second repeater 105' while the repeater portion 108' of the second repeater 105', to the transmitter portion 107 of the first repeater 105. According to this structure, the station signal CS is supplied through the receiver portion 106, the repeater portion 108, and the transmitter portion 107' to the substation 27 while the substation signal SS is transmitted through the receiver portion 106', the repeater portion 108', and the transmitter portion 107 to the center station 25. Thus, a two-way transmission is accomplished even when the insulator 115 is interposed between the pipes 20 and 20'.

While this invention has thus far been described in conjunction with several embodiments thereof, it will be readily possible for those skilled in the art to put this invention into practice in various manners. For example, each of the station and the substation signals may be a modulated signal obtained by modulating, by a pulse signal, a carrier signal having a frequency less than 3 kilohertz. It is possible to transmit each of the signals only one time on the pipe. In this case, the coincidence circuits 56 and 76 and the signal combining circuit 34 become very simple. The metal pipe may be coated by an insulator layer placed inside or outside a metal layer. In addition, use is possible, as the switch 44, of either a mechanical switch or a semiconductor switch.

What is claimed is:

1. A monitoring system for monitoring a degree of corrosion of a metal pipe surrounded by a mass, said degree increasing with time and varying from location to location along the length of said pipe, said pipe having a distribution of electrical potential along its length, the voltage levels of said potential distribution depending at least in part on said degree of corrosion, said system comprising:

a center station coupled to said pipe at a predetermined location; and a substation coupled to said pipe at a preselected location and including means for detecting the degree of corrosion at said preselected location, means for supplying data signals to said pipe including a substation signal which is representative of the degree of corrosion detected at said substation; and means at said center station responsive to the substation supplied data signals transmitted through said pipe to monitor the degree of corrosion detected at said substation.

2. A monitoring system for monitoring a degree of corrosion of a metal pipe surrounded by a mass, said degree increasing with time and varying from location to location along the length of said pipe, said pipe having a distribution of electrical potential along its length, the voltage levels of said potential distribution depending at least in part on said degree of corrosion, said system comprising:

a center station coupled to said pipe at a predetermined location; and a substation coupled to said pipe at a preselected location and including means for detecting the degree of corrosion at said preselected location, means for supplying data signals to said pipe including a substation signal which is representative of the degree of corrosion detected at said substation;

means at said center station responsive to the substation supplied data signals transmitted through said pipe to monitor the degree of corrosion detected at said substation;

a plurality of said substations, each of said substations being identified by an individually associated address and being coupled to said pipe at prescribed locations, respectively;

said center station comprising:

selecting means for selecting said address numbers, one at a time;

first signal producing means responsive to the selected address number for producing at least once a first address signal which is representative of the selected address number; and first signal supplying means coupled to said pipe and to said address producing means for supplying said first address signal to said pipe as a station identification signal;

each substation comprising:

measuring means coupled to said pipe for measuring the increase in the degree of corrosion at one of said prescribed locations to which said substation is coupled, to produce a resulting signal which is representative of the measured degree;

holding means for holding a second address signal which is representative of the address number assigned to said each substation;

second signal producing means responsive to the first address signal supplied through said pipe and responsive to said second address signal for producing a first energizing signal only upon coincidence of the address numbers represented by the supplied first address signal and said second address signal; and second signal supplying means responsive to said first energizing signal for supplying said pipe with said resulting signal as the substation signal of said substation.

3. A monitoring system as claimed in claim 2, wherein:

said second signal supplying means is further responsive to said second address signal and comprises:

combining means operatively coupled to said second producing means, said holding means, and said measuring means for combining said second address signal with said resulting signal in response to said energizing signal to produce a combination signal which includes a combination of said second address signal followed by said resulting signal; and transmitting means for supplying said pipe with said combination signal as said substation signal;

said center station comprising:

processing means operatively coupled to said pipe and said selecting means for processing the combination signal supplied through said pipe to monitor the degree of corrosion with reference to said first address signal and the second address signal included in said combination signal.

4. A monitoring system as claimed in claim 3, wherein:

said first producing means comprises:

control signal generating means for generating a control signal comprising a code indicative of a predetermined operation to be carried out by each substation; and arranging means responsive to said first address signal and said control signal for arranging said first address signal and said control signal to supply said first signal supplying means with a concatenation signal representative of a concatenation of said first address signal followed by said control signal;

said first signal supplying means supplying said concatenation signal as said station output signal to said pipe.

5. A monitoring system as claimed in claim 4, wherein said center station and said each substation forms an automatic repetition system for twice transmitting at least one of said first address signal, said control signal, said result signal, and said second address signal between said center station and said each substation.

6. A monitoring system as claimed in claim 5, said first address signal comprising a first preceding and a first succeeding address signal, each of which is representative of the selected address number, said control signal comprising a preceding and a succeeding control signal, wherein said second producing means comprises:

first comparing means responsive to the first preceding and the first succeeding address signals supplied through said pipe for comparing the first preceding and the first succeeding address signals to produce a first coincidence signal upon a coincidence of the address numbers thereby represented;

second comparing means responsive to said second address signal and a prescribed one of the first preceding and the first succeeding address signals for comparing said prescribed address signal and said second address signal to produce a second coincidence signal upon a coincidence of the address number represented by said prescribed address signal with the address number represented by said second address signal; and first gating means connected to said first and said second comparing means for producing said first energizing signal upon presence of said first and said second coincidence signals;

said first comparing means being further responsive to the preceding and the succeeding control signals supplied through said pipe for comparing the preceding and the succeeding control signals to produce a third coincidence signal upon a coincidence of both of them;

decoding means responsive to said third coincidence signal and to a predetermined one of said preceding and said succeeding control signals for decoding said predetermined control signal to produce a decoded signal; and means for carrying out said predetermined operation in accordance with said decoded signal.

7. A monitoring system as claimed in claim 6, said second address signal comprising a second preceding and a second succeeding address signal, each of said signals being representative of said assigned address number, said resulting signal comprising a preceding and a succeeding resulting signal, each representative of said measured degree, wherein said processing means comprises:

storing means for storing said first address signal;

third comparing means for comparing the second preceding and the second succeeding address signals supplied through said pipe to produce a fourth coincidence signal upon coincidence of the address numbers thereby represented;

fourth comparing means responsive to a preselected one of the second preceding and the second succeeding address signals, and said stored first address signal for comparing said preselected address signal and said stored first address signal to produce a fifth coincidence signal upon a coincident of both of said preselected address signal and said stored first address signal; and second gating means connected to said third and said fourth comparing means for producing a second energizing signal upon the presence of said fourth and said fifth coincidence signals;

said third comparing means comparing the preceding and the succeeding resulting signals supplied through said pipe to a sixth coincidence signal upon a coincidence of both result signals;

said processing means further comprising monitoring means responsive to said fifth and said sixth coincidence signals, a predetermined one of the preceding and the succeeding resulting signals for monitoring the degree of corrosion with reference to said selected address number only when supplied with said fifth and said sixth coincidence signals.

8. A detecting system as claimed in any one of claims 1 through 7, further comprising an additional station coupled to said pipe between said center station and said substation for repeating said station and said substation signals.

* * * * *